US005322004A

United States Patent [19]

Sims

[11] Patent Number: 5,322,004

[45] Date of Patent: Jun. 21, 1994

[54] TELESCOPING FLUID ACTUATOR

[76] Inventor: James O. Sims, 1100 Brooks St., Decatur, Ala. 35601

[21] Appl. No.: 22,355

[22] Filed: Feb. 25, 1993

[51] Int. Cl.[5] ..... F01B 7/20

[52] U.S. Cl. ..... 92/52; 92/53; 92/113; 91/167 R; 91/169; 91/181

[58] Field of Search ..... 92/51, 52, 53, 113; 91/167 R, 168, 170 R, 173, 178, 181, 169

[56] References Cited

U.S. PATENT DOCUMENTS

| | | | |
|---|---|---|---|
| 3,128,674 | 4/1964 | Ganchar et al. | 91/167 R |
| 3,272,132 | 9/1966 | Stoelting et al. | 92/164 |
| 3,920,084 | 11/1975 | Russell, Jr. | 92/53 |
| 3,957,125 | 5/1976 | Russell, Jr. | 92/53 |
| 3,973,468 | 8/1986 | Russell, Jr. | 92/53 |

*Primary Examiner*—Thomas E. Denion

*Attorney, Agent, or Firm*—Phillips & Beumer

[57] ABSTRACT

A telescoping fluid actuator assembly including a housing having a plurality of concentrically disposed fluid actuators disposed therein. Each fluid actuator includes a cylindrical housing enclosing a piston and piston rod. Fluid passage means is provided for alternately directing fluid pressure to the front and back piston faces of each piston to effect forward and rearward movement of the pistons and the associated piston rod. The innermost concentric fluid actuator has a piston rod extending from the housing for engaging a workpiece for movement thereof. All of the concentrically mounted fluid actuators, except the innermost fluid actuator, is provided with a hollow piston rod which forms the cylinder housing for adjacent concentric fluid actuators.

3 Claims, 1 Drawing Sheet

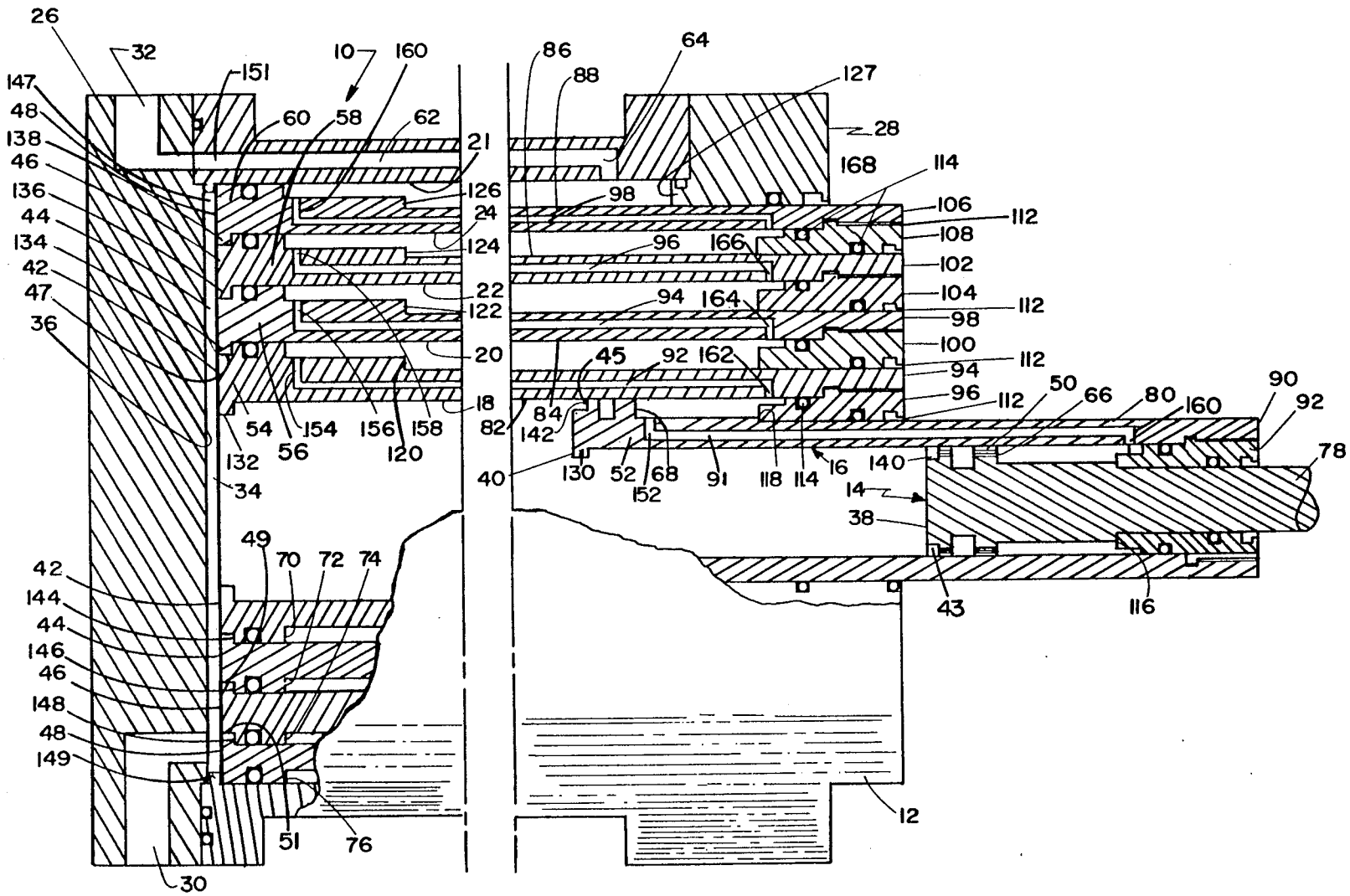
10
12
14
16
18
20
21
22
24
26
28
30
32
34
36
38
40
42
43
44
45
46
47
48
49
50
51
52
54
56
58
60
62
64
66
68
70
72
74
76
78
80
82
84
86
88
90
91
92
94
96
98
100
102
104
106
108
112
114
116
118
120
122
124
126
127
130
132
134
136
138
140
142
144
146
147
148
149
151
152
154
156
158
160
162
164
166
168

TELESCOPING FLUID ACTUATOR

FIELD OF THE INVENTION

This invention is directed generally to fluid actuators and more particularly to fluid actuators having a plurality of piston and piston rod assemblies mounted in telescoping relation.

BACKGROUND OF THE INVENTION

Typical telescoping fluid actuators available in the art include telescoping piston/piston rods which are extendible responsive to fluid pressure acting on the piston for moving the piston and associated rod. However, once the telescoping piston/piston rods are displaced to an extended position, it was necessary to relieve the pressure on the piston by venting the cylinder and manually forcing the extended piston/piston rods back into their retracted positions in the cylinder. Alternatively, in order to retract the piston/piston rod assemblies back into the cylinder, long, flexible hoses have been mounted externally of the cylinder and in communication with the return side (face) of the pistons so that fluid pressure may be directed into the cylinder against the face of the pistons for displacing the piston/piston rod assemblies to its initial (unextended) position in the cylinder.

Both of these approaches have shortcomings. In the first case, once the piston/piston rod has been extended, it becomes a burdensome task for one to reach and manually exert an external force on the end of the extended piston rod while venting the cylinder. In the second case, which relies on the use of long flexible hoses which must move (extend) with each extending telescoping piston/piston assembly to provide the return fluid pressure, the fluid lines become entangled or at the very least pose a significant problem when the fluid cylinders are not used because they must be left to clutter up the space adjacent to the fluid actuators.

To overcome these noted difficulties, the applicant has provided a compact telescoping fluid actuator system which includes internal passageways which extend with the extending piston/piston rod assemblies while maintaining each face of the pistons in fluid communication with a source of fluid pressure without the need of extendible fluid lines.

It is, therefore, an object of the present invention to provide a telescoping fluid actuator system.

It is another object of the present invention to provide an internally ported fluid actuator system having plural telescoping piston/piston rod assemblies.

These and other objects of the present invention will become more readily apparent from the following description and accompanying drawings.

BRIEF DESCRIPTION OF THE DRAWING

The single FIGURE is an elevational sectional view of the telescoping fluid actuator of the present invention. The FIGURE illustrates all of the pistons of the concentrically mounted fluid actuator assemblies, except for the innermost fluid actuator assembly, being in the retracted position. The piston and piston cylinder housing of the innermost assembly is shown to be extended from its retracted position, such retracted position being similar to the position of the pistons of the remaining fluid actuator assemblies of the FIGURE.

DESCRIPTION OF THE PREFERRED EMBODIMENT

As seen in the FIGURE, a fluid actuator assembly 10 is shown to include a cylinder 12 housing a plurality of telescoping concentrically mounted piston/piston rod assemblies including an innermost assembly 14, intermediate assemblies 16, 18, 20, and 22, and outermost assembly 24. Cylinder 12 is shown to include a bore 21, cylinder head 26, and an end cap 28. Head 26 is provided with a first fluid inlet/outlet passage 30 and a second fluid inlet/outlet passage 32. Passage 30 is in communication with a groove 34 disposed in a surface 36 of head 26 whereby fluid inlet pressure is applied against the forward faces 38, 40, 42, 44, 46, and 48 of pistons 50, 52, 54, 56, 58, and 60, respectively, of assemblies 14, 16, 18, 20, 22, and 24 to displace the piston/piston rod assemblies to an extended position. Fluid passage 32 is in communication with a longitudinal passage 62 which extends substantially along the length of cylinder 12 and includes an end portion 64 which communicates into the cylinder 12.

Each piston 50, 52, 54, 56, 58, and 60 includes second (rear) faces 66, 68, 70, 72, 74, and 76 which receive fluid pressure from passage 62 to move the piston/piston rod assemblies to their retracted positions. Each of the piston/piston rod assemblies 14, 16, 18, 20, 22, and 24, respectively, include a piston rod 78, 80, 82, 84, 86, and 88. Piston rod 80 is provided with a distal end 90 having a piston rod support assembly 92 rigidly secured thereto. Piston rod 78 extends through rod support assembly 92 for reciprocal movement therein. Piston rod 82 is provided with a distal end 94 having a piston rod support assembly 96 rigidly secured thereto. Rod 80 extends through rod support assembly 96 for reciprocal movement therein. Piston rod 84 is provided with a distal end 98 having a piston rod support assembly 100 rigidly secured thereto. Rod 82 extends through rod support assembly 100 for reciprocal movement therein. Piston rod 86 is provided with a distal end 102 having a piston rod support assembly 104 rigidly secured thereto. Rod 84 extends through rod support assembly 104 for reciprocal movement therein. Rod 88 is provided with a distal end 106 having a piston rod support assembly 108 rigidly secured thereto. Rod 86 extends through rod support assembly 108 for reciprocal movement therein. It is to be understood that in each of the above-described piston rod and rod support assemblies, the support assemblies may be made integral with distal ends of the piston rods or may be secured in threaded relation. It is also to be understood that appropriate wipers 112 and O-ring seals 114 or the like are mounted in the support assemblies.

Stop means are provided to limit the forward (extended) movement of each piston in the surrounding hollow piston rod. As can be seen in the FIGURE, piston rods 78, 80, 82, 84, and 86 are provided with shoulders 116, 118, 120, 122, and 124 which are disposed for engagement with the respective rear surfaces of piston rod support assemblies 92, 96, 100, 104, and 108 of piston/piston rod assemblies 14, 16, 18, 20, and 22 to stop the forward movement of the piston/piston rod assemblies 14, 16, 18, 20, and 22. The outer piston/piston rod assembly 24 which includes rod 88 is limited in its movement by a should 126 on rod 88 engaging an inner projecting surface 127 of member 28, thereby securing the piston/piston rod assemblies in the housing responsive to the forward movement of the pistons.

Additional stop means are provided to limit the rearward movement of the piston/piston rod assemblies. This stop means is in the form of inwardly projecting shoulders disposed on the interior surface of each piston and on the housing for engaging an outwardly projecting shoulder on the exterior surface of each piston. As seen in the FIGURE, an inwardly projecting shoulder 130, 132, 134, 136, and 138 is provided on the interior surface of pistons 52, 54, 56, 58, and 60. These inwardly projecting shoulders are disposed for engagement with outwardly projecting shoulders 140, 142, 144, 146, and 148 on pistons 50, 52, 54, 56, and 58 to limit the rearward (retracted) movement of each piston relative to the adjacent outer piston. The outer piston 60 includes a shoulder 147 which abuts with an inner projecting annular shoulder 149 of housing 12, thereby retaining each of the piston/piston rod assemblies in the housing responsive to rearward movement of the piston/piston rod assemblies.

As stated above, cylinder 12 includes a longitudinal passageway 62 which communicates with a source of fluid pressure and with the interior of the cylinder. A first end 151 of passage 62 communicates with inlet/outlet passage 32, and the second end 64 of passage 62 communicates into the cylinder housing 12. Each of the piston rods 80, 82, 84, 86, and 88 have longitudinal passages 91, 92, 94, 96, and 98 which respectively includes first end portions 152, 154, 156, 158, and 160 which extend outwardly from the respective hollow piston rods and into and adjacent open outer space provided between adjacent piston rods. End portion 160 communicates into bore 21 of cylinder 12. Each passage 90, 92, 94, 96, and 98 includes second end portions 160, 162, 164, 166, and 168 which extend inwardly into an adjacent open inner space provided between the adjacent piston rods.

In operation, upon pressurization of the fluid actuator by the admission of pressurized fluid into inlet 30, the piston/piston rod assemblies are displaced forwardly (extended) in the cylinder body 12. The FIGURE illustrates two piston/piston rod assembly fully expanded. As can be seen in the FIGURE, the piston rods are prevented from excessive movement by the stop means provided between the above-discussed annular shoulders on the piston rod and the end surface of the piston rod support assembly of the adjacent piston/piston rod assemblies. The remaining piston rod assemblies are illustrated in their non-expanded positions. As can be seen, these non-expanded piston/piston rod assemblies are prevented from excessive rearward movement as a result of the stop means projections provided on the internal wall of each adjacent hollow piston and the groove provided in each piston.

To retract the expanded piston/piston rod assemblies, fluid pressure is directed through passage 32 and into cylinder housing 12 where it is further directed through passages 98, 96, 94, 92, and 90 and into the annular spaces between adjacent hollow piston rods to act on the rear faces of the pistons for rearward displacement of the associated piston and piston rods.

I claim:

1. A telescoping fluid actuator comprising:

a housing including a body having first and second ends, with a cylinder head member being mounted at said first end and an end cap mounted at said second end and a first and second inlet/outlet passage, respectively, disposed in said cylinder head in communication with the interior of said housing and adapted for connection with a source of fluid, said end cap having an internally projecting shoulder thereon;

manifold means positioned in said housing adjacent to said end cap to receive fluid from said first fluid inlet;

a plurality of fluid actuator assemblies concentrically mounted in said housing for reciprocal movement, said plurality of fluid actuator assemblies including an outermost fluid actuator assembly, an innermost fluid actuator assembly, and at least one intermediate fluid actuator assembly concentrically mounted intermediate said outermost and said innermost fluid actuator assembly, said outermost and said intermediate fluid actuator assemblies defined by a hollow piston rod having a hollow piston mounted therein, said innermost fluid actuator assembly defined by a hollow piston rod defining a cylinder for enclosing a work-engaging piston which is disposed for extending therefrom, each of said hollow piston rods having a first and second ends and forming an annular wall defining a cylindrical housing for adjacent said concentrically mounted fluid actuator assemblies, said first end of each said rod having a said piston secured thereto, each said piston having first and second faces, said first face of each said piston disposed adjacent to said manifold means for receiving fluid pressure from said first inlet;

internal fluid passage means longitudinally formed in said annular wall of each said cylindrical housings in communication with said second fluid inlet for directing fluid to said second face of each said piston for movement of each said piston and piston rod assembly to a retracted position;

piston rod support means secured to the inner surface of each said hollow piston adjacent to said second end thereof of each said fluid actuator assembly, said support means being defined by an inwardly extending annular member disposed circumferentially around the piston rod carried in the adjacent said hollow piston in which said piston rod is carried, said support member having an annular shoulder thereon;

first stop means for limiting movement of said piston and piston rod of said outermost fluid actuator assembly in the retracted position;

second stop means for limiting movement of said piston and piston rod of said at least one intermediate and said innermost fluid actuator assemblies in the retracted position; and said first and second stop means disposed for retaining said first faces of said piston and piston rod assemblies of said outermost, said at least one intermediate, and said innermost fluid actuator assemblies in a common plane which is adjacent to and in direct communication with said manifold.

2. A fluid actuator as set forth in claim 1 including third stop means for limiting movement of said intermediate and innermost piston rod assemblies responsive to said intermediate and innermost piston rod assemblies assuming the extended position, said third stop means being formed by engaging surfaces of said second face of said pistons and said annular shoulder of said piston support means of said intermediate and innermost piston rod assemblies.

3. A fluid actuator as set forth in claim 2 including fourth stop means for limiting movement of said outermost piston rod assembly responsive to said outermost assembly assuming said extended position, said fourth stop means being formed by said annular shoulder of said outermost piston rod engaging said inwardly projecting shoulder of said end cap.

* * * * *